United States Patent [19]

Schmidt

[11] 4,049,250

[45] Sept. 20, 1977

[54] CRUCIBLE

[75] Inventor: Walter Schmidt, Schaffhausen, Switzerland

[73] Assignee: Prolizenz AG, Chur, Switzerland

[21] Appl. No.: 661,439

[22] Filed: Feb. 26, 1976

[30] Foreign Application Priority Data

Mar. 6, 1975 Switzerland ..... 2845/75

[51] Int. Cl.[2] ..... F27B 14/10

[52] U.S. Cl. ..... 266/275

[58] Field of Search ..... 266/275, 280, 281; 432/156; 75/65 R; 427/241, 405; 29/198, 199; 23/273 SP

[56] References Cited

U.S. PATENT DOCUMENTS

| | | | |
|---|---|---|---|
| 1,043,579 | 11/1912 | Eldred | 266/275 |
| 1,684,800 | 9/1928 | Maximoff et al. | 266/280 |
| 2,872,299 | 2/1959 | Celmer et al. | 23/273 SP |

*Primary Examiner*—Gerald A. Dost

*Attorney, Agent, or Firm*—Ernest F. Marmorek

[57] ABSTRACT

A crucible, for use in connection with oxidizing melts on the interior at elevated temperatures includes a crucible body composed of a material selected from the group consisting of platinum metals and tungsten, and a continuous coating of a metal disposed on the inner surface of the body, the coating metal being substantially non-alloying with the material and having a low affinity for oxygen.

8 Claims, 4 Drawing Figures

CRUCIBLE

CROSS REFERENCE TO RELATED APPLICATION

Reference is had to the co-pending patent applications [assigned to Prolizenz AG.] of Warner Borer et al., Ser. No. 661,434 filed Feb. 26, 1976, and of Walter Schmidt, Ser. No. 664,700 filed Mar. 8, 1976, and Ser. Nos. 661,433 and 661,438 filed Feb. 26, 1976, each entitled CRUCIBLE [and filed on or about the filing date of the instant patent application]

BACKGROUND OF THE INVENTION

The invention relates to a crucible for use in connection with oxidizing melts at elevated temperatures and the method of forming the crucible.

Generally, it is known in the prior art that for melting substances having a melting point above 1,900° C only a crucible composed of graphite or a metal having a very high melting point can be considered. If the substance is an oxidizing agent or is to be melted in an oxygen containing atmosphere , the prior art teaches the use of the platinum metal iridium having a melting point of 2,454° C for the crucible material.

In the case of a substance which is an oxidizing agent or the presence of an oxidizing atmosphere, the demands on the crucible material are very great. Even a crucible of iridium can be dissolved or corroded by conventional melts so that the useful life of the crucible is greatly reduced. This problem is reflected in the high cost in the material and molding. Furthermore, the melted substance can be contaminated by the dissolved iridium.

The instant invention endeavors to eliminate many of the known disadvantages of the prior art crucibles and thereby provide an economy.

SUMMARY OF THE INVENTION

One of the principal objects of the invention is a crucible, for use in connection with oxidizing melts on the interior at elevated temperatures, including a crucible body composed of a material selected from the group consisting of platinum metals and tungsten, a continuous coating of a metal disposed on the inner surface of the body, the coating metal being substantially non-alloying with the material and having a low affinity for oxygen.

Another object of the invention is a method for forming a crucible for use in connection with oxidizing melts on the interior at elevated temperatures, including the steps of applying to the interior surface of a crucible body composed of a material selected from the group consisting of platinum metals and tungsten a continuous coating of metal, the coating metal having been selected to be substantially non-alloying with the material and having a low affinity for oxygen and having a high degree of surface diffusion.

Further objects and advantages of the invention will be set forth in part in the following specification and in part will be obvious therefrom without specifically referred to, the same being realized and attained as pointed out in the claims hereof.

The instant crucible accordingly comprises the features of construction, the combination of elements and arrangement of parts which will be exemplified in a construction hereinafter set forth in the scope of the application of which will be indicated in the claims.

The instant method accordingly comprises the several steps and the relation of one or more of such steps with respect to each of the others, all as exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description, taken in connection with the accompanying drawings, and which.

DESCRIPTION OF THE PREFERRED EMBODIMENTS

Figure 1A:
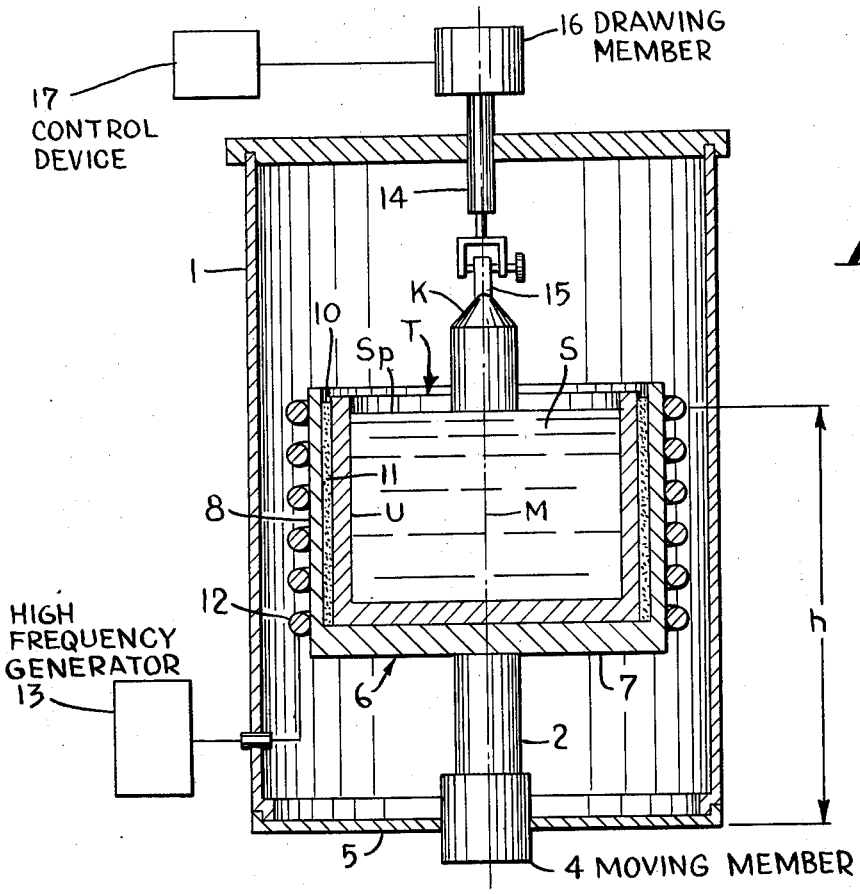
FIG. 1A shows a partial vertical sectional view of one embodiment of a crystal drawing device.

Generally, it has been found that a crucible body composed of iridium or tungsten can be protected against an oxidizing melt by applying a coating metal which is substantially non-alloying with the crucible body and possesses a high degree of surface diffusion and/or a low affinity to oxygen such as gold. In the case of gold, a relatively small quantity is needed for coating the inside surface of the crucible body. Gold forms no alloy with tungsten and virtually does not alloy with iridium and possesses a high degree of surface diffusion so that it will diffuse over the inside surface of the crucible body to form a continuous coating and thereby protect the crucible body from oxidation or chemical attack. This prolongs the useful life of an iridium body for use in growing an oxide single crystal or the like and permits the iridium crucible body to be replaced by less expensive tungsten.

Gold is considered to be particularly advantageous because it possesses and extremely low affinity to oxygen.

Ordinarily, a gold crucible cannot be considered for melting oxidizing compounds at elevated temperatures because gold melts at about 1,069° C. For the temperature range of about 1,000° to about 1,900° C, crucibles are generally made of light and heavy platinum metals (Pt or Pt/Rh). These metals, however, do not provide good mechanical stability at the elevated temperatures.

For temperatures above about 1,700° C, iridium is primarilly used in practice. Even iridium at these elevated temperatures reacts with oxygen and tends to corrode.

In the case of the instant invention, iridium is used for the crucible body which primarily serves as a supporting structure for the gold coating. At the elevated working temperatures, the gold adheres to the inside surface of the crucible body to form a liquid layer sufficient to protect the iridium from chemical attack.

The inner surface of the crucible body can be coated by heating it and placing in it a metal having a high degree of surface diffusion and/or low affinity to oxygen. After the metal liquefies it is spread over the inner surface of the crucible body to form a continuous coating.

The inner surface of the crucible body can be coated even in the presence of a melt in the crucible body by adding the coating metal to the melt. Experiments have shown that in such a case the corrosion of the crucible body is quickly terminated when the coating metal performs a continuous coating.

Crucible bodies of iridium and tungsten having a gold coating have been found to be particularly suitable for the production of doped saphires and rubies. In addition, melts of spinels, ferrites, and other garnets such as ytrium-aluminum garnet have been produced with a tungsten crucible body having a gold coating in accordance with the instant invention.

In carrying the invention into effect, some embodiments have been selected for illustration in the accompanying drawings and for description in the specification, reference being had to FIGS. 1A, 1B, 2A, and 2B.

Figure 1B:
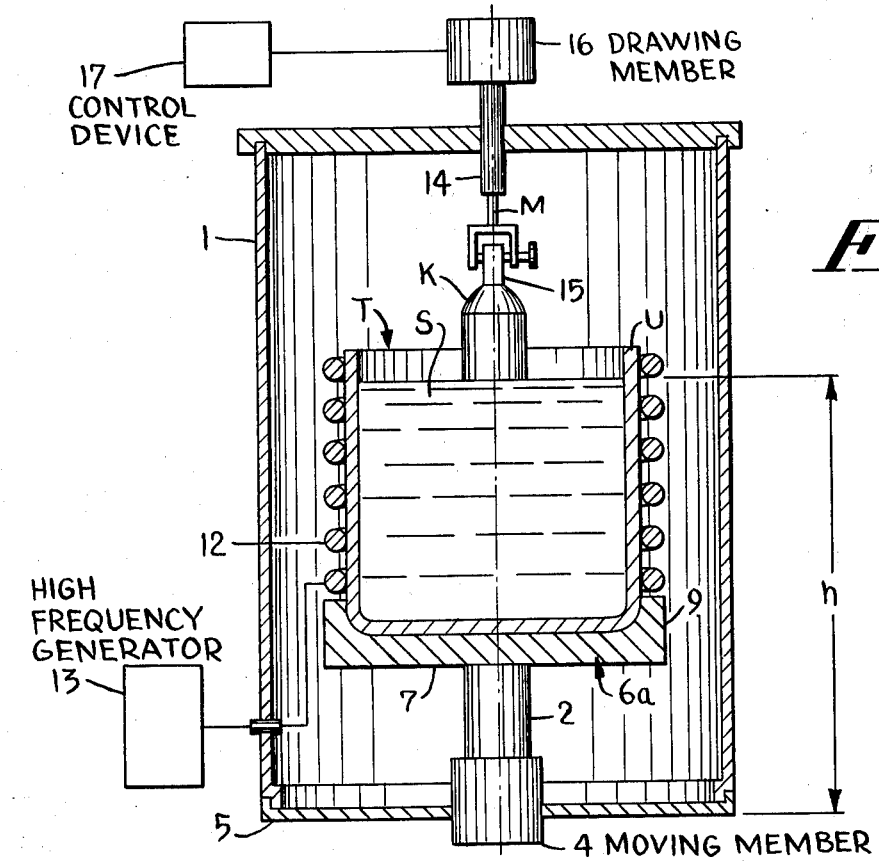
FIG. 1B shows a partial vertical sectional view of another crystal drawing device.

Generally, FIGS. 1A and 1B show devices for growing a single crystal according to the so-called Czochralski process. In FIG. 1A, housing 1 encloses a supporting device 6 for a crucible T arranged on a vertical shaft 2 extending along the axis M of the device 6. The shaft 2 can be vertically displaced by a moving member 4 so that the level Sp of a melt S in the crucible T is kept at a constant distance h from the bottom surface 5 of the housing 1.

The supporting device 6 includes a bottom plate 7 and an insulating wall 8. In contrast, FIG. 1B shows a supporting device 6a including a bottom plate 7 and an annular flange 9.

FIG. 1A shows a cylindrical vertical wall U of the crucible T and the insulating wall 8 define an annular region 10 which is filled with powdered aluminum oxide 11.

In both FIGS. 1A and 1B, heat is generated by a high-frequency induction coil 12 connected to a high-frequency generator 13.

In operation, a seed crystal 15 extends from the vertical drawing rod 14 into the melt S and is slowly withdrawn by a drawing member 16 to produce a crystal K. The drawing member 16 is operated by a control device 17.

Figure 2A:
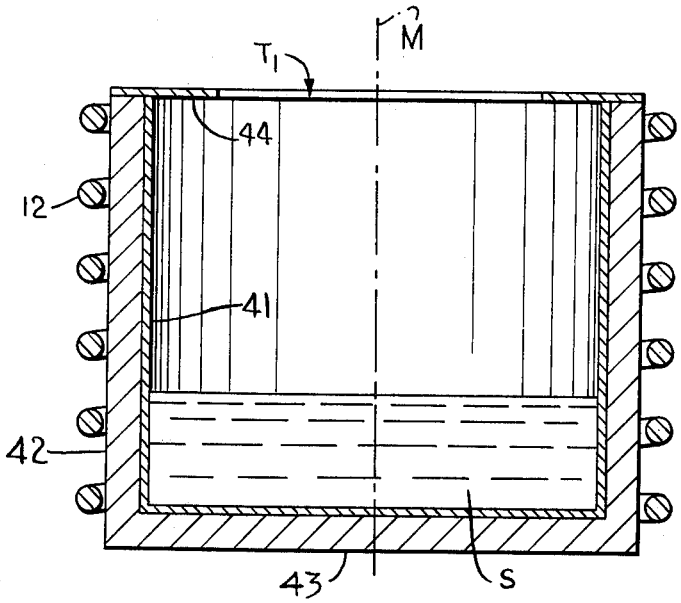
FIG. 2A shows a partial vertical sectional view of one embodiment according to the invention.
Figure 2B:
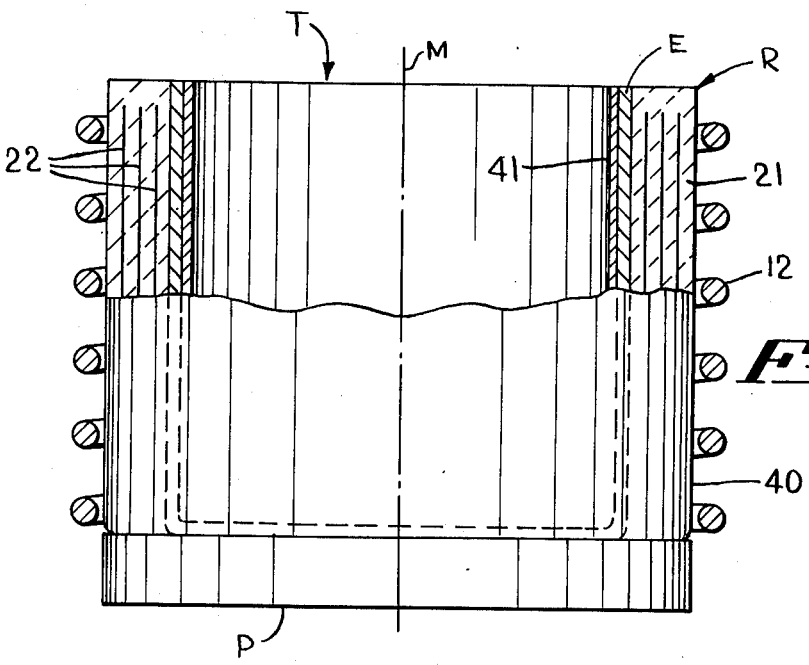
FIG. 2B shows a partial vertical sectional view of another embodiment according to the invention.

The crucibles $T_1$ and T shown in FIGS. 2A and 2B are intended to receive the melt S.

The crucible $T_1$ includes a relatively thick cylindrical wall 42, a bottom 43 made of tungsten or iridium, and a gold coating 41. Condensation screens 44 are mounted above the melt S to compensate for gold which is likely to be evaporated for temperatures above 1,900° C (vapor pressure about 10 Torr). Generally, gold vapors condense on the condensation screens 44 and accumulate and drop back into the melt S.

In FIG. 2B, the crucible T includes an insert E, a cylinder R surrounding the insert E, a common base plate P composed of magnesium oxide on which the insert E and the cylinder R are disposed, and a gold coating 41.

The cylinder R includes a body 21 composed of a plasma sprayed ceramic oxide and cylinders 22 composed of iridium foil and embedded concentrically with respect to the axis M. The cylinders 22 reinforce the body 21 and, because they are metallic, help to heat the cylinder R especially after the cylinder R has reached a temperature of about 1,600° C. At about that temperature, the cylinders 22 couple strongly into the field of the high-frequency heating coil 12 which surrounds the external side 40.

The inner area of the crucibles $T_1$ and T defines the growth area for the crystal K which is drawn from the melt S at a temperature of about 1,800° C.

The gold coating 41 can be applied by placing a small piece of gold onto the bottom surface 43 of the crucible $T_1$ and applying heat. At about 1,069° C, the gold melts to form a ball and at high temperatures the gold creeps along the bottom surface 43 and along the walls 42 because of its high degree of surface diffusion. After a while, a thin cohesive coating 41 is obtained.

In order to observe the advantage of coating 41, the coating 41 was removed from the crucible $T_1$ and then the crucible $T_1$ was filled with gadolinium-gallium-garnet (GGG). Subsequently, attempts to draw a crystal from the melt S were made and found to be very difficult due to the chemical attack of the iridium along the crystallization zone. Thereafter, 5 grams of gold were placed in the melt S and almost immediately the corrosion or chemical attack terminated as evidenced by the appearance of a clear and iridium-free crystal surface. This experiment demonstrated that the gold in the form of the coating 41 prevents the corrosion of iridium by the gadolinium-gallium-garnet melt.

It may be that the pure gold could become partially suspended in a melt in the form of minute droplets. If so, for such cases, smaller amounts of gold would be used or a gold alloy would be used to form the coating 41.

I wish it to be understood that I do not desire to be limited to the exact details of construction shown and described, for obvious modifications will occur to a person skilled in the art.

Having thus described the invention, what I claim as new and desired to be secured by Letters Patent, is as follows:

1. A crucible for use with an oxidizing melt at elevated temperatures, comprising a crucible body composed of a material selected from the group consisting of platinum metals and tungsten and which is able to withstand the elevated melt temperatures but is subject to corrosion due to the oxidizing character of the melt; and a continuous anti-corrosion coating on the inner surface of said crucible body, said coating being of a metal which is substantially non-alloying with the material of said crucible body and which has a low affinity for oxygen so as to protect said material of said crucible body from said oxidizing melt and thereby prolong the useful life of said body.

2. The crucible as claimed in claim 1, wherein said coating metal possesses a high degree of surface diffusion.

3. The crucible as claimed in claim 1, wherein said coating is in the form of a liquid layer.

4. The crucible as claimed in claim 1, wherein said coating metal is gold or a gold alloy.

5. The crucible as claimed in claim 1, further comprising at least one condensation screen disposed at the top of the crucible, whereby vapors of said coating metal can condense on said condensation screen.

6. A method of forming a crucible for use with an oxidizing melt at elevated temperatures, comprising the steps of providing a crucible body composed of a material selected from the group consisting of platinum metals and tungsten;

forming at the interior surface of said body a continuous coating of a metal selected to be substantially non-alloying with said material of said body and to have a low affinity for oxygen and a high degree of surface diffusion, so that said coating protects said crucible body against corrosion by said melt and thereby prolongs the useful life of said crucible body.

7. The method as claimed in claim 6, wherein said coating is applied prior to the use of said oxidizing melt.

8. The method as claimed in claim 6, wherein the step of applying the coating is carried out in the presence of said oxidizing melt.

* * * * *